US005522493A

United States Patent [19]

Spada et al.

[11] Patent Number: 5,522,493

[45] Date of Patent: Jun. 4, 1996

[54] SUPPLY HOPPER FOR DELICATE, ROD-SHAPED PRODUCTS, IN PARTICULAR IN CIGARETTE PACKAGING MACHINES

[75] Inventors: Valter Spada, Marzabotto; Giuseppe Tosi, Modena, both of Italy

[73] Assignee: SASIB S.p.A., Bologna, Italy

[21] Appl. No.: 284,142

[22] Filed: Aug. 2, 1994

[30] Foreign Application Priority Data

Aug. 6, 1993 [IT] Italy ..... GE93A0076

[51] Int. Cl.[6] ..... B65G 47/12

[52] U.S. Cl. ..... 198/446; 198/418.3; 131/282; 53/151

[58] Field of Search ..... 198/418.3, 446, 198/454, 455, 533; 131/282, 283; 53/148–151

[56] References Cited

U.S. PATENT DOCUMENTS

| | | | |
|---|---|---|---|
| 2,618,421 | 11/1952 | Basus | 53/151 |
| 2,759,309 | 8/1956 | Kemp | 53/151 |
| 2,809,768 | 10/1957 | Pollman et al. . | |
| 3,435,940 | 4/1969 | Seragnoli | 198/418.3 |
| 4,496,055 | 1/1985 | Green et al. | 131/282 |

FOREIGN PATENT DOCUMENTS 2372085 6/1978 France .

*Primary Examiner*—Joseph E. Valenza
*Attorney, Agent, or Firm*—Larson and Taylor

[57] ABSTRACT

Supply hopper for delicate, rod-shaped products, in particular in cigarette packaging machines, which hopper (1) is provided in its lower part with a plurality of separate discharge channels (2), each of which is divided by means of intermediate walls (4) into several ducts (3) which are vertical and parallel to one another, in each of which ducts (3) there is formed at least one substantially vertical row of cigarettes (S) which are superimposed on one another, whereas above the upper end (104) of each intermediate wall (4) there is provided a roller (6) which is horizontal and parallel to the axis of the cigarettes (S) in the hopper (1), and is rotated, preferably with oscillatory motion. According to the invention, in order to prevent to a large extent the formation of bridges of cigarettes which block the ducts (3), the rollers (6) are disposed quincuncially relative to a horizontal plane, i.e. they are alternately offset parallel to one another upwards and downwards.

5 Claims, 3 Drawing Sheets

SUPPLY HOPPER FOR DELICATE, ROD-SHAPED PRODUCTS, IN PARTICULAR IN CIGARETTE PACKAGING MACHINES

The object of the invention is a supply hopper for delicate, rod-shaped products, in particular in cigarette packaging machines, which hopper is provided in its lower part with a plurality of separate discharge channels, each of which is divided by means of intermediate walls into several ducts which are vertical and parallel to one another, in each of which ducts there is formed at least one substantially vertical row of cigarettes which are superimposed on one another, whereas above the upper end of each intermediate wall there is provided a roller which is horizontal and parallel to the axis of the cigarettes in the hopper, and is rotated, preferably with oscillatory motion.

In known hoppers of this type, the rollers all have an identical circular transverse cross-section, and are disposed with their axes aligned in a common horizontal plane. The passage gaps between the rollers are usually larger than the diameter of two cigarettes. The rollers are driven in an oscillating manner around their axis, and the angular amplitude of their oscillation is usually relatively large, for example from 270° to 300°.

Hoppers of this type have the disadvantage that in the area between two adjacent rollers, above the mouth of the individual ducts, the cigarettes can obstruct one another and the rollers, so as to form bridges which close the duct beneath, preventing the cigarettes from dropping therein.

The relatively large amplitude of oscillation of the rollers also gives rise to drive action in the direction opposite that of fall into the corresponding duct of the cigarette immediately adjacent to the roller, such that the cigarette is sucked inside the hopper.

A further disadvantage consists in that rollers with a circular cross-section transmit their rotary motion to the cigarettes, which are thus rotated around their own axis. This is detrimental in particular to the quality of filling of the cigarettes, since it can cause tobacco to emerge from the head of the cigarettes, and thus empty the latter, contributing to the formation of faulty products.

The object of the invention is to provide a hopper of the type initially described, such that, owing to relatively simple and inexpensive means, the disadvantages of known supply hoppers can be eliminated.

In particular, the object of the invention is a hopper of the type initially described, which to a large extent prevents the formation of bridges of cigarettes, thus stopping the cigarettes from dropping into the ducts of the hopper, at the same time ensuring that the cigarettes are subjected to the minimum amount displacement or stress, which could give rise to damage, and in particular emptying thereof.

The above-described objects of the invention are obtained by means of a hopper of the type initially described, in which the rollers are disposed quincuncially relative to a horizontal plane, i.e. they are alternately offset parallel to one another upwards and downwards.

The relative offsetting of the axes of the rollers corresponds substantially to approximately half the diameter of the cigarettes, or to an order of magnitude of that type.

By this means, the arrangement of the rollers is substantially suited to the natural quincuncial arrangement of the cigarettes in the area above the hopper, such that to a large extent this prevents interference between adjacent cigarettes, leading to reciprocal wedging and the formation of bridges.

This arrangement of the rollers is further harmonized relative to the arrangement of the mass of cigarettes in the area above the hopper, since the transverse cross-section of the rollers is approximately that of the cigarettes, and the transverse gap between two adjacent rollers, and the width of the duct below, at least in the mouth area, are smaller than twice the diameter of the cigarettes and larger than the diameter of a single cigarette, and preferably approximately one and a half times the diameter of the cigarette. By this means each duct receives a row of single superimposed cigarettes.

According to another improvement provided by the invention, which further prevents the formation of bridges, at the same time eliminating the effect of suction of the cigarettes by the rollers, and rotation of the cigarettes around their own axis, the rollers have a polygonal transverse cross-section.

Advantageously, the rollers are oscillated in both directions around a predetermined median position, in which the upper surface of the roller is substantially horizontal and constitutes a support surface for the cigarette above. The amplitude of oscillation in both directions is such that in each extreme oscillation position, the said upper support surface is in a substantially vertical position. Thus each cigarette which is supported on a roller is tilted in a position of alignment with the upper mouth of the corresponding duct beneath, without interfering negatively, in the sense of reciprocal wedging, with the adjacent cigarettes, and without undergoing rotational movements around its own axis, which could cause damage, and in particular emptying.

According to a particularly advantageous embodiment, the rollers have a square transverse cross-section. In this case, the rollers oscillate by 90° clockwise and 90° anticlockwise, whereas they are disposed such that in the median angular position between the two extreme oscillation positions, and in the said two extreme oscillation positions, the roller has two vertical sides and two horizontal sides.

The object of the invention also consists of other features which further perfect the above-described supply hopper and which are disclosed hereafter.

The specific features of the invention and the resulting advantages will become apparent from further details of the description of some preferred embodiments, illustrated by way of non-limiting example, in the attached drawings, in which.

Figure 1:
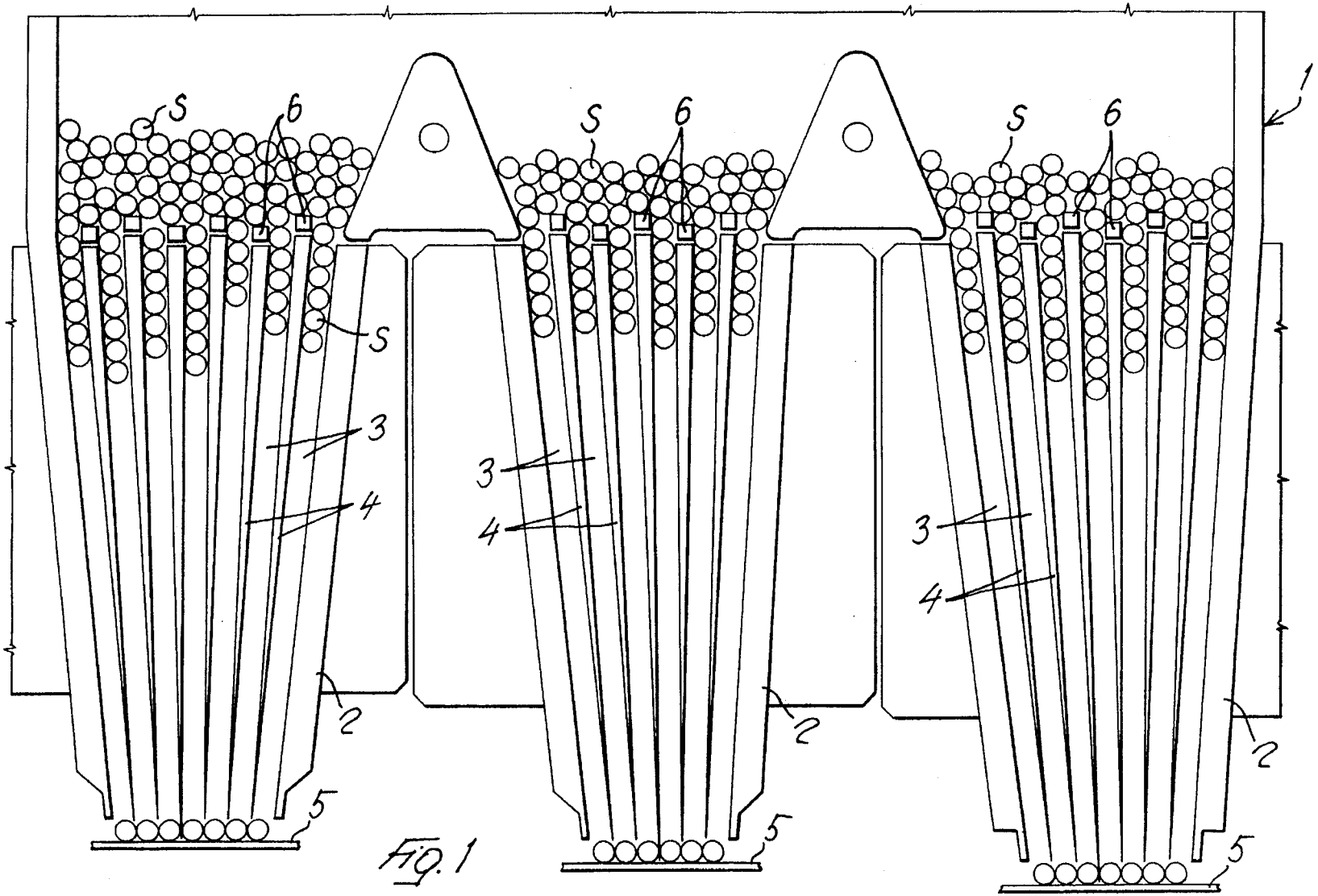
FIG. 1 is a front view of a supply hopper according to the invention in a cigarette packaging machine.
Figure 2:
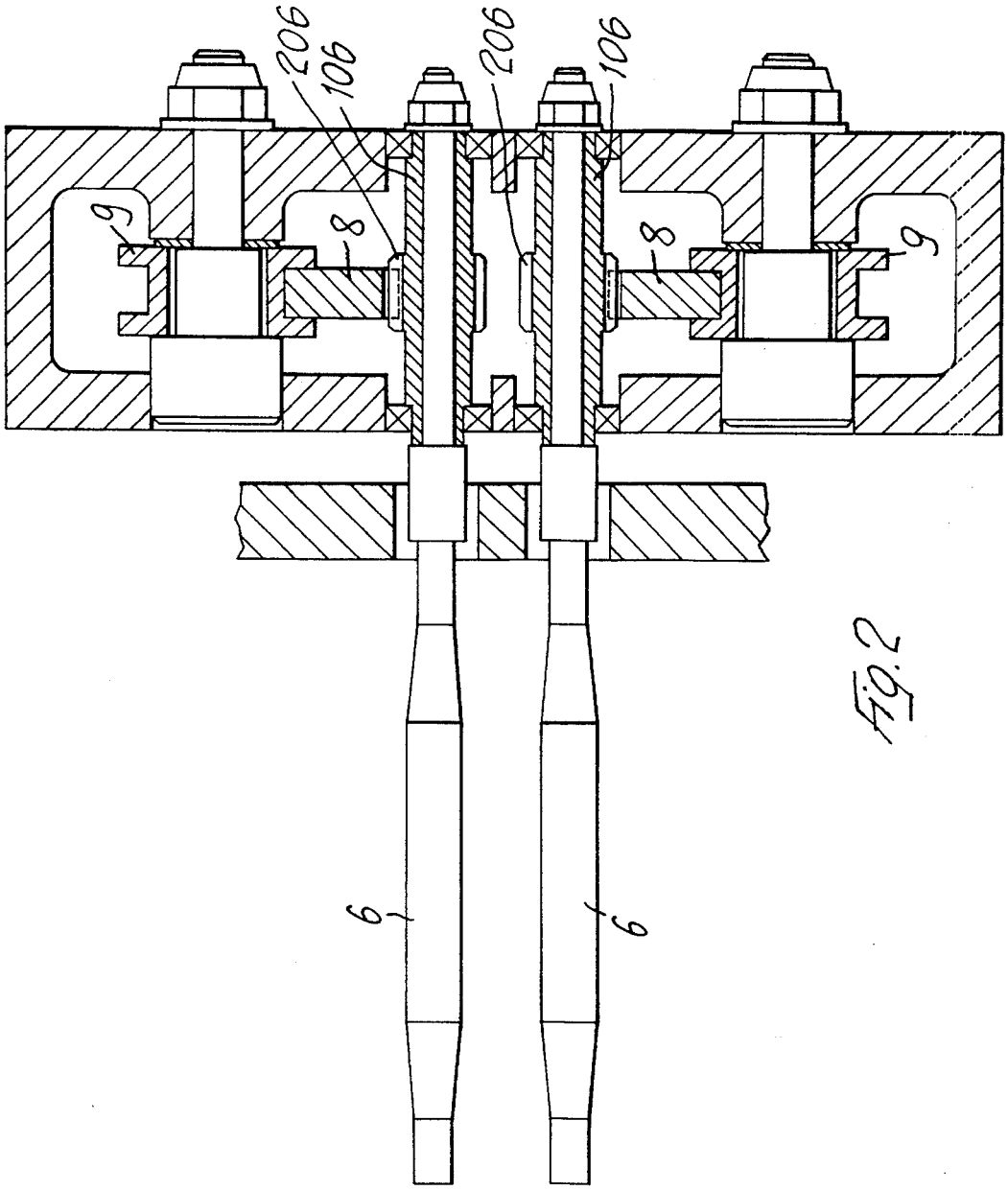
FIG. 2 is an enlarged lateral view, in partial cross-section, of a detail of a roller and the drive means thereof.

FIGS. 1 and 2 show a cigarette supply hopper in a cigarette packaging machine. On its lower side, the hopper 1 has three separate discharge channels 2, each of which is subdivided by means of intermediate walls 4 into a specific number of substantially vertical ducts 3. Each channel 2 supplies a number of cigarettes S which corresponds to the number of ducts 3 on a collection plane 5, such that on the said plane 5 there is formed a row of cigarettes which are adjacent to one another transversely to their axis, which row is then transferred axially, together with a row of cigarettes associated with each of the subsequent two channels 2, into a collection cradle (not shown) of the packaging machine.

The cigarettes S are accommodated in the hopper 1, with their axes oriented horizontally and parallel to one another. The ducts 3 of each channel 2 are slightly larger than the diameter of a cigarette, and thus each accommodates a substantially vertical row consisting of individual cigarettes S-superimposed on one another.

The intermediate walls 4 end substantially at the upper end of the corresponding channel 2. In particular, the upper heads 104 of the intermediate walls 4 end at levels which are offset alternately upwards and downwards relative to a horizontal plane. Above the upper head 104 of each intermediate wall 4 there is a roller 6. The rollers 6 are disposed at a slight distance from the opposite heads 104 of the intermediate walls 4, such that they can be rotated freely around their axis without interfering with the intermediate walls 4, and are oriented with their axes parallel to the axes of the cigarettes S. The rollers 6 have a transverse cross-section which is not round, and in particular is square, and have dimensions which are approximately those of the cigarettes S. In particular, the length of the diagonal of the rollers 6 corresponds substantially to the width of the upper head 104 of the intermediate walls 4 and to the diameter of the cigarettes. The rollers 6 are also disposed quincuncially corresponding to the heads 104 of the intermediate walls. As can be seen in FIG. 2, the rollers 6 are supported in a projecting manner in the hopper 1, and have a rear axial extension 106 which is supported such that it can be rotated by means of bearings in part of the frame of the hopper. The axial extension 106 supports a pinion 206 in a manner such that it does not rotate reciprocally, which pinion engages with a rack 8. The rack 8 is oriented horizontally and transversely to the rollers 6, and is supported such as to slide longitudinally, in both directions, on lower guide rollers 9 which can rotate freely. The pinions 206 of both rollers 6 engage with two racks 8, which are activated with oscillatory linear motion by means of a motor and a drive, not shown in detail. It will be appreciated that other rotary means of driving the rollers 6 can be used, which can be of any type, and can consist of cams, lever systems or the like.

Figure 3:
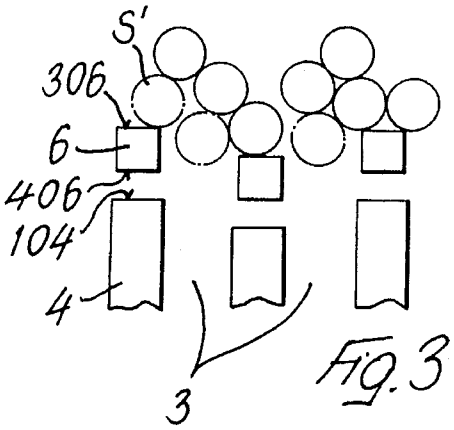
FIGS. 3 to 6 show schematically various operative stages of the hopper rollers according to the preceding figures, during clockwise oscillation.
Figure 4:
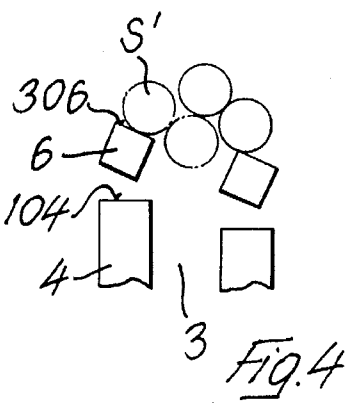
Figure 5:
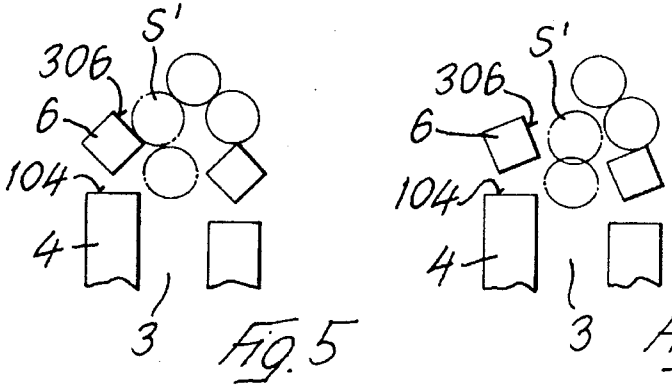
Figure 6:
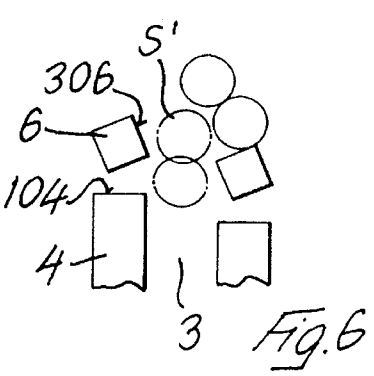

With reference to FIG. 3 in particular, the width of the mouth opening of the ducts 3, at least in the mouth area, and the distance between the opposite surfaces of the rollers 6 is larger than, or approximately one and a half times, the diameter of the cigarettes, but less than twice the diameter of the cigarettes. By this means, no more than one cigarette at a time can enter the ducts 3.

With reference to the present embodiment, for a cigarette diameter of 8 mm, the following geometric arrangement is particularly efficient: distance between two adjacent rollers 16.5 mm; side of the square rollers 6 mm; reciprocal offsetting horizontally between two adjacent rollers of approximately at least half the length of the side, or half the length of the diagonal of the rollers 6.

The rollers 6 are all oscillated in phase with one another, in both directions around an intermediate position, such that the upper sides 306 and lower sides 406 thereof are horizontal.

The amplitude of oscillation is such that in the extreme oscillation positions clockwise and anticlockwise, the upper and lower sides 306, 406 of the rollers 6 are substantially vertical. In this case, since the rollers 6 have a square cross-section, the amplitude of oscillation is 90° clockwise and 90° anticlockwise, relative to the said intermediate position.

FIGS. 3 to 6 illustrate respectively the intermediate oscillation position of some rollers 6, and three successive intermediate stages of oscillation thereof clockwise. As is also apparent from FIG. 1, the natural arrangement of the cigarettes S in the area of the hopper 1 above the channels 2 is quincuncial. The quincuncial arrangement of the rollers 6 with the above-described distances apart substantially harmonizes with and corresponds to that of the cigarettes S. The upper side 306 of each roller 6 in the intermediate oscillation position, and in this case in the two extreme oscillation positions, constitutes a support surface for a single cigarette S' (FIG. 3). During rotation of the rollers 6, the cigarette S' is tilted by the surface 306 into a position which coincides with the mouth of the associated duct 3 beneath. The quincuncial arrangement of the rollers 6 and the width of the mouth opening, which at least is less than twice the diameter of the cigarettes, prevents the cigarettes S from interfering with the cigarette S' and with the rollers 6, which would cause mutual wedging and thus form a bridge preventing access to the duct 3 by the cigarette S' and the cigarettes above. In addition, movement of the cigarettes which interfere with the rollers 6 is such as to give rise to a large extent only to translation, thus preventing movements of the cigarettes, and in particular rotation around their own axis which could give rise to emptying.

Figure 7:
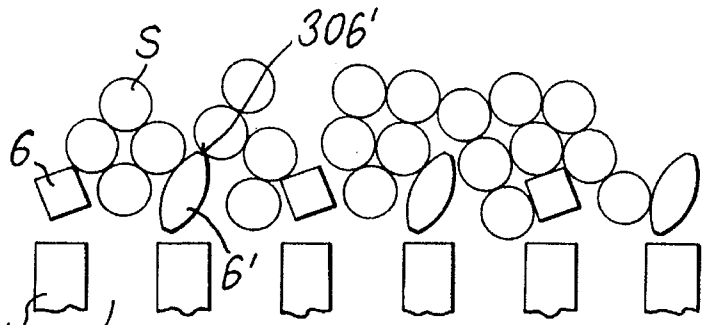
FIGS. 7 and 8, similarly to FIG. 3, show two variant embodiments of the invention.

FIG. 7 shows a possible variant embodiment of the invention. In this case, harmonization with the natural quincuncial arrangement of the cigarettes in the hopper 1 is obtained slightly differently from in the embodiment previously described. The rollers 6, 6' are disposed with their axis in a common horizontal plane, whereas they have alternately an elongate form in the direction of the vertical axis, in their intermediate oscillation position. The rollers 6, 6' thus have alternately upper support surfaces 306, 306' for the cigarettes S which are offset from one another upwards and downwards relative to a horizontal plane, i.e. which are disposed quincuncially. In the example in FIG. 7, the rollers 6 have a square cross-section similar to that in the previous example, and alternate with rollers 6' with an ellipsoid shape flattened at the ends of the larger diameter. The smaller diameter of the rollers 6' corresponds substantially to the side of the rollers 6.

Figure 8:
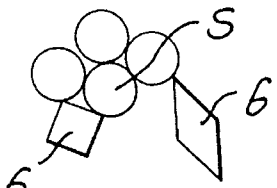

In the variant in FIG. 8, the roller 6' is in the form of a diamond or rhomboid.

We claim:

1. A discharge hopper for rod-shaped products comprising:

an upper part and a lower part, the products being disposed in said upper part with axes thereof horizontal and parallel to one another and with the products in a horizontal quincuncial pattern;

a plurality of separate vertical discharge channels in said lower part for the products;

intermediate walls in each of said discharge channels which divide each said discharge channel into several ducts, said ducts of each said discharge channel being vertical and parallel to one another such that in each said duct there is formed at least one substantially vertical row of horizontally disposed products which are superimposed on one another, each said duct having a mouth, and each said intermediate wall being stationary and including an upper head; and a respective roller provided above the respective upper head of each said intermediate wall which is operated in an oscillatory motion from a predetermined median position to extreme oscillation positions at 90° clockwise and 90° anticlockwise from the median position, each said roller having an axis which is horizontal and parallel to the axes of the products, adjacent said rollers in each respective said duct having axes which are disposed alternately with a permanent offset to one another upwards and downwards relative to a horizontal plane, the offset of the axis of each adjacent said roller being vertically about equal to half a diameter of the products or an order of magnitude thereof, a free transverse gap between adjacent said rollers and a width of the respective mouth of the said duct thereunder being smaller than twice the diameter of the products and larger than a single diameter of the products, and each said roller having a square transverse cross section and including an upper support surface, said upper support surface being (a) horizontal and supporting a product when said roller is in the median position, and (b) being substantially vertical when said roller is in each extreme oscillation position whereby in the median position between the two extreme oscillation positions, and in the said two extreme oscillation positions, each roller has two vertical sides and two horizontal sides, and such that the products are singly located in the ducts without interference from adjacent products.

2. Hopper according to claim 1, wherein the diagonal width of the rollers is approximately equal to the diameter of the products.

3. Hopper according to claim 1, wherein the rollers have sides 6 mm long, a distance between rollers of 16.5 mm, and the offset is 3 to 4 mm.

4. Hopper according to claim 1, wherein the upper heads of the intermediate walls are disposed alternately with a permanent offset to one another upwards and downwards relative to the horizontal plane, similar to the associated said rollers.

5. Hopper according to claim 2, wherein the upper heads of the intermediate walls are disposed alternately with a permanent offset to one another upwards and downwards relative to the horizontal plane, similar to the associated said rollers.

* * * * *